US009103625B2

(12) United States Patent
Masters

(10) Patent No.: US 9,103,625 B2
(45) **Date of Patent: *Aug. 11, 2015**

(54) FIREARM WITH KEYHOLE-SHAPED MOUNTING POINTS

(71) Applicant: Accuracy International of North America, Inc., Fredericksburg, VA (US)

(72) Inventor: Philip Steven Masters, Fleet (GB)

(73) Assignee: ACCURACY INTERNATIONAL OF NORTH AMERICA, INC., Fredericksburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/057,525

(22) Filed: Oct. 18, 2013

(65) Prior Publication Data

US 2014/0041273 A1 Feb. 13, 2014

Related U.S. Application Data

(63) Continuation-in-part of application No. 12/930,378, filed on Jan. 5, 2011, now Pat. No. 8,752,320.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16
USPC ..... 42/71.01, 90, 85, 72, 96, 77, 124
See application file for complete search history.

(56) References Cited

U.S. PATENT DOCUMENTS

| | | | | |
|---|---|---|---|---|
| 8,752,320 | B2 * | 6/2014 | Masters | 42/71.01 |
| 2009/0100734 | A1 * | 4/2009 | Swan et al. | 42/71.01 |
| 2012/0144717 | A1 * | 6/2012 | Peterson et al. | 42/94 |

* cited by examiner

*Primary Examiner* — Reginald Tillman, Jr.
(74) *Attorney, Agent, or Firm* — Bennet K. Langlotz; Langlots, Patent & Trademark Works, Inc.

(57) ABSTRACT

A firearm with keyhole-shaped rail mounting points has a forend element having an exterior surface and interior surface. The forend element defines a plurality of rail mounting apertures extending from the interior surface to the exterior surface. Each of the apertures has a first portion with a first diameter to closely receive a fastener head of a first diameter. Each of the apertures has a second portion with a second width less than the first diameter size to receive a shank portion of a fastener. There may be a recess on the interior surface size to receive the fastener head, the recess positioned at the second portion.

9 Claims, 6 Drawing Sheets

FIREARM WITH KEYHOLE-SHAPED MOUNTING POINTS

CROSS-REFERENCE TO RELATED APPLICATION

This is a Continuation-in-Part of U.S. patent application Ser. No. 12/930,378, entitled "FIREARM WITH KEYHOLE-SHAPED RAIL MOUNTING POINTS," filed Jan. 5, 2011, now issued as U.S. Pat. No. 8,752,320.

FIELD OF THE INVENTION

The present invention relates to firearms, and more particularly for rail systems for mounting accessories on firearms.

BACKGROUND OF THE INVENTION

Rail systems are used for removably mounting accessories such as optical aiming devices on rifles. Such rails may be integrated with forearms or handguard elements that surround the barrel on firearms, such as the M4/AR15 configuration.

Integrated rails provide a solid and secure mounting location. However, integrated systems must have several rails of substantial length, to be able to accommodate all possible user accessory configurations. This undesirably increases the weight of the system.

Other systems have detachable rails that allow the user to install rails only where they are needed, and only of the length needed. While this decreases weight (and the discomfort and other disadvantages) of having needless rails where the hand is to grip, it suffers from other disadvantages. First, such systems may be difficult or complex to install. Second, they may require custom modification of parts, such as drilling and tapping holes where needed. Third, the attachment locations may be in limited locations due to the need to relocate fasteners such as threaded inserts (or may increase cost and weight by using an excessive number of fasteners).

A further significant disadvantage of systems having modular rails that may be mounted in various locations on the forearm or handguard of a rifle stock is the susceptibility to loosening. If the mount for a rifle scope becomes loose, this can cause significant aiming errors. The user may not notice the loosening or misalignment until after taking a shot that misses or strikes an unintended target.

Therefore, a need exists for a new and improved firearm that can be used to attach rails to a forend tube in such a manner that the rails do not change position over time. In this regard, the various embodiments of the present invention substantially fulfill at least some of these needs. In this respect, the firearm with keyhole-shaped rail mounting points according to the present invention substantially departs from the conventional concepts and designs of the prior art, and in doing so provides an apparatus primarily developed for the purpose of attaching rails to a forend tube in such a manner that the rails do not change position over time.

An example of an approach to attaching an object to a surface using a keyhole slot is found on an adjustable slide board, which is from a field that is not analogous to the current invention. The slide board features two sets of longitudinally aligned keyhole slots. Bumpers are attached to the upper surface of the slide board by inverted T-nuts inserted into the keyhole slots and thumbscrews passed through bores in either end of the bumpers and threaded into the T-nuts. The underside of the slide board includes recesses at the narrow end of each keyhole slot that receive the heads of the T-nuts to secure the T-nuts within the keyhole slots when the thumbscrews are tightened. The bumpers are positioned laterally across the width of the upper surface of the slide board. The two sets of keyhole slots are offset so that the bumpers are attached at an angle to the sides of the slide board rather than perpendicularly.

SUMMARY OF THE INVENTION

The present invention provides an improved firearm with keyhole-shaped rail mounting points, and overcomes the above-mentioned disadvantages and drawbacks of the prior art. As such, the general purpose of the present invention, which will be described subsequently in greater detail, is to provide an improved firearm with keyhole-shaped rail mounting points that has all the advantages of the prior art mentioned above.

To attain this, the preferred embodiment of the present invention essentially comprises a forend element having an exterior surface and interior surface. The forend element defines a plurality of rail mounting apertures extending from the interior surface to the exterior surface. Each of the apertures has a first portion with a first diameter to closely receive a fastener head of a first diameter. Each of the apertures has a second portion with a second width less than the first diameter size to receive a shank portion of a fastener. There may be a recess on the interior surface size to receive the fastener head, the recess positioned at the second portion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
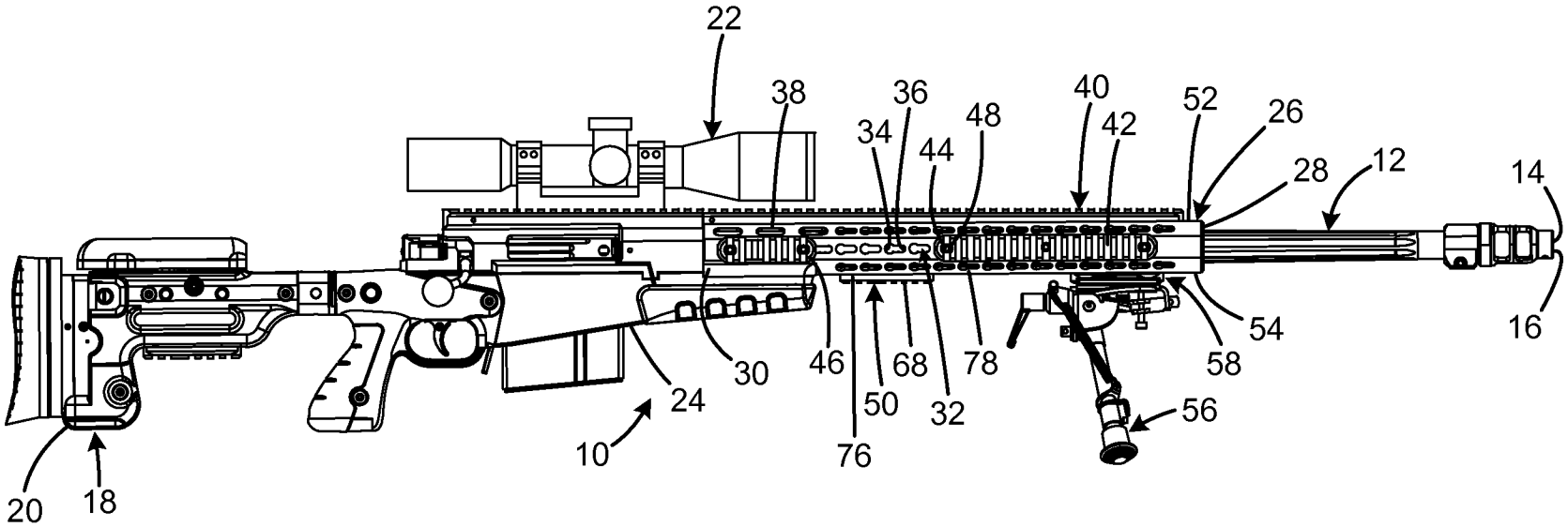
FIG. 1 is a side view of the current embodiment of the firearm with keyhole-shaped rail mounting points constructed in accordance with the principles of the present invention.

A preferred embodiment of the firearm with keyhole-shaped rail mounting points of the present invention is shown and generally designated by the reference numeral 10.

FIG. 1 illustrates improved firearm with keyhole-shaped rail mounting points of the present invention. More particularly, the firearm with keyhole-shaped rail mounting points 10 is a rifle. The rifle has a stock 18 at its rear 20 and a barrel 12 with a muzzle 14 at its front 16. The muzzle end of the barrel protrudes from the front 28 of a handguard or forend tube 26, which serves as a barrel shroud element. An upper receiver 24 connects the rear 30 of the forend tube to the stock.

The top 52 of the forend tube forms an integral upper rail 40, although this may be omitted in alternative embodiments, or replaced with a modular rail according to a preferred embodiment of the invention. A scope 22 is attached to the upper rail 40. A plurality of ventilation holes 38 is present in the rear of the forend tube. The ventilation holes prevent the barrel from overheating when the firearm is fired repeatedly. The exterior 78 of the forend tube is operable for gripping by user and is octagonal in shape, forming eight exterior surfaces. Each of these surfaces, except for the top one, has a plurality of keyhole slots 32. In alternative embodiments, any polygonal, circular, elliptical, or other cross section may be employed.

The keyhole slots 32 are axially aligned into rows that each run parallel to the major axis of the forend and barrel. Each keyhole slot has a wider circular rear portion 34 and a narrower oblong front portion 36. The keyhole slots enable short rail 46, short rail with flush cup mount 50, short rail 58, and long rail 42 to be securely mounted to the forend tube with fasteners in a manner that will be described in more detail subsequently. A bipod 56 is shown attached to the short rail 58. However, any combination of rail locations, quantities, and lengths may be used.

The modular rail segments enable the user to position rails of the size that is needed at only the locations where they are needed. Being able to control the amount of forend tube exterior surface that is encumbered by rails makes the firearm lighter and less likely to catch on objects.

Figure 2:
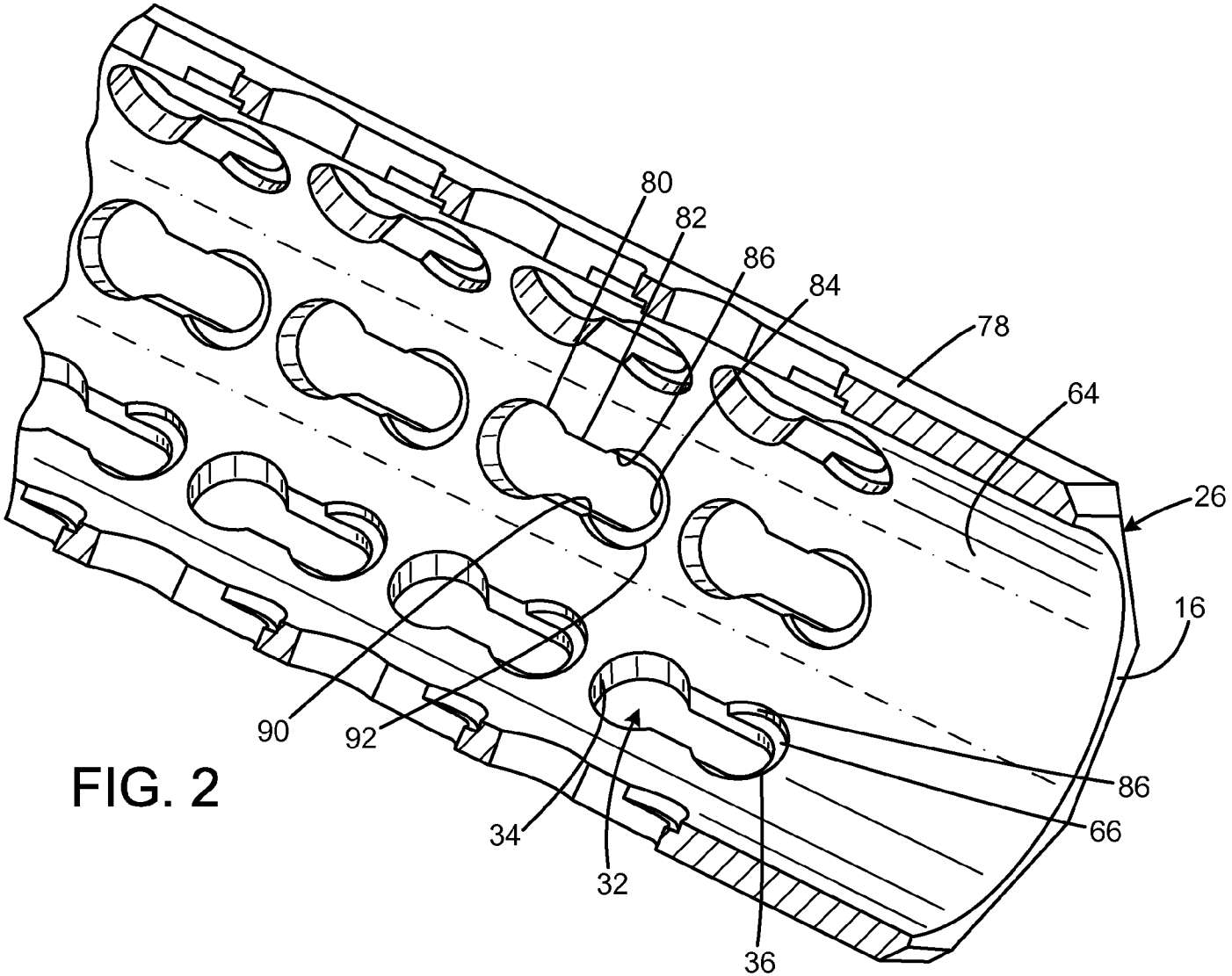
FIG. 2 is a side sectional perspective view of the current embodiment of the forend tube of the present invention.

FIG. 2 illustrates the interior 64 of the forend tube 26 of the present invention, which defines a barrel passage that encompasses at least a portion of the barrel 12. More particularly, the keyhole slots 32 present in the forend tube are clearly visible. The forend tube has a thickness of 3.0 mm. Each keyhole slot opens through the forend tube and has a wider rear 34 that narrows at the front 36. This orientation prevents recoil from causing a fastener inserted into the keyhole slot from sliding out the wider end of the keyhole slot.

The rear of the keyhole slot defines a circular arc segment 80 having a diameter of 8.0 mm. The arc segment 80 opens into a rectangular portion 82 that is 7.1 mm long and 5.5 mm wide. The front of the rectangular portion 82 terminates in a circular arc segment having a diameter of 5.5 mm that forms an interior front surface 84. An interior surface portion of the front of the rectangular portion 82 opens into a recess 66 defined by a circular arc segment 92 having a diameter of 8.0 mm, which is closely proportionate to that diameter of aperture portion 80. The recess is 1 mm deep at its minimum and has interior rear surfaces 86 and 90. The recess 66 in the interior surface of the forend tube at the front of the keyhole slot closely receives the head of a fastener, and prevents a tightened or even slightly loosened fastener from sliding rearwards within the keyhole slot, even if the fastener is only loosely tightened.

Figure 3:
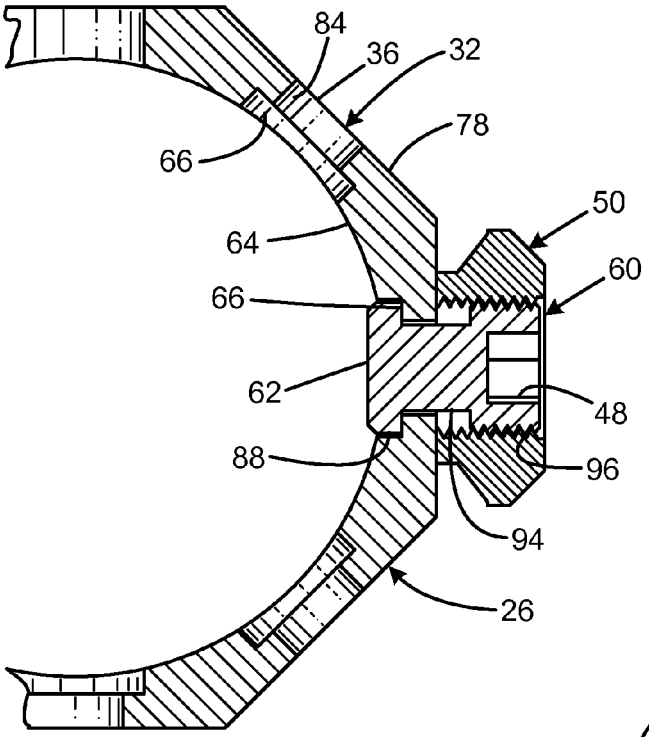
FIG. 3 is an end sectional view of the current embodiment of the forend tube of the present invention.

FIG. 3 illustrates the forend tube 26 of the present invention with a fastener 60 inserted through the keyhole slot 32 to attach a short rail with flush cup mount 50 to the forend tube. More particularly, the fastener 60 is a T-nut having a shaft portion 94 and a disc-shaped head 62 with an outer diameter surface 88. The head has a diameter of 7.6 mm, which is sized to be closely received by the recess 66, and a thickness of 2.0 mm. The shaft portion has a diameter of 5.0 mm, which is sized to be closely received by the front of the rectangular portion 82, and a length of 4.0 mm. The T-nut is inverted so that the disc-shaped head is inserted through the wider rear portion of the keyhole slot and positioned within the forend tube. The head has a diameter that is slightly less than that of the wider rear portion of the keyhole slot, but is greater than the narrower front portion of the keyhole slot. The recess 66 at the front of the keyhole slot is sized to closely receive the head. Both the outer diameter surface of the head and the interior surfaces of the recess may be tapered to provide a centered fit in the manner of a flat head screw without relying on a close dimensional match between recess and head diameter.

In addition to the plain head 62 that engages with the key hole slot's recess 66, the T-nut includes a threaded portion 96 that terminates in an M8×4 mm threaded hex socket head 48. This features a left-hand thread so the user tightens the socket head in an intuitive clockwise direction although the head 62 is actually drawing out and into the recess 66 in the forend tube. Each T-nut is fabricated as a single piece.

Figure 4:
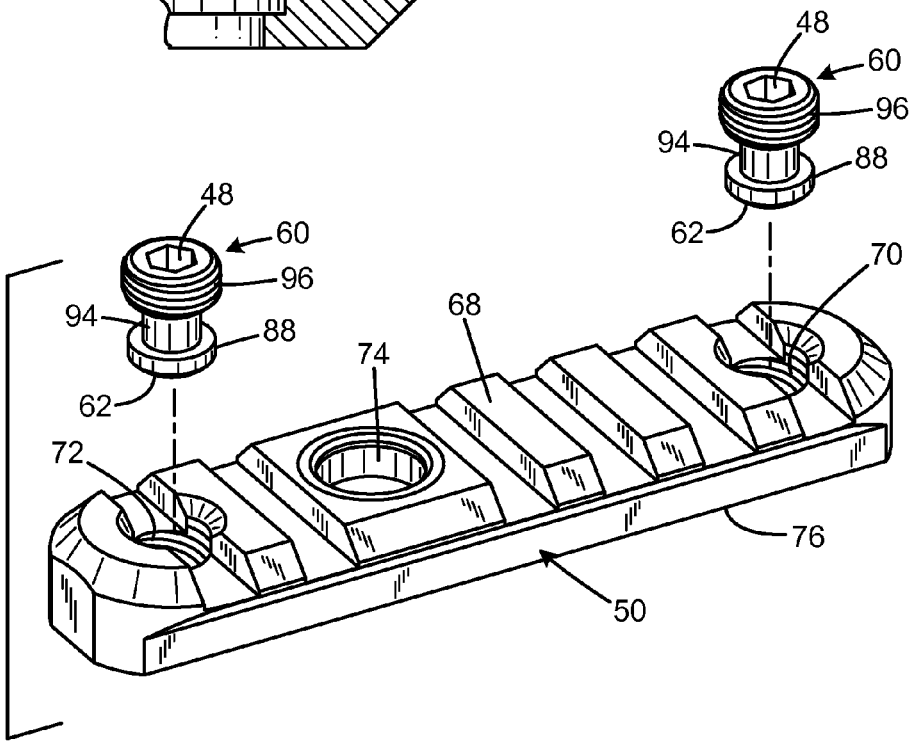
FIG. 4 is a top perspective view of the current embodiment of the short rail with flush cup mount of the present invention.

FIG. 4 illustrates the short rail with flush cup mount 50 of the present invention with T-nuts 60. More particularly, the rail 50 has threaded bores 70 and 72 at either end, and a flush cup mount 74 formed by its top 68. The threaded bores each receive the threaded portion 96 of a T-nut prior to being attached to the exterior surface of the forend tube.

Figure 5:
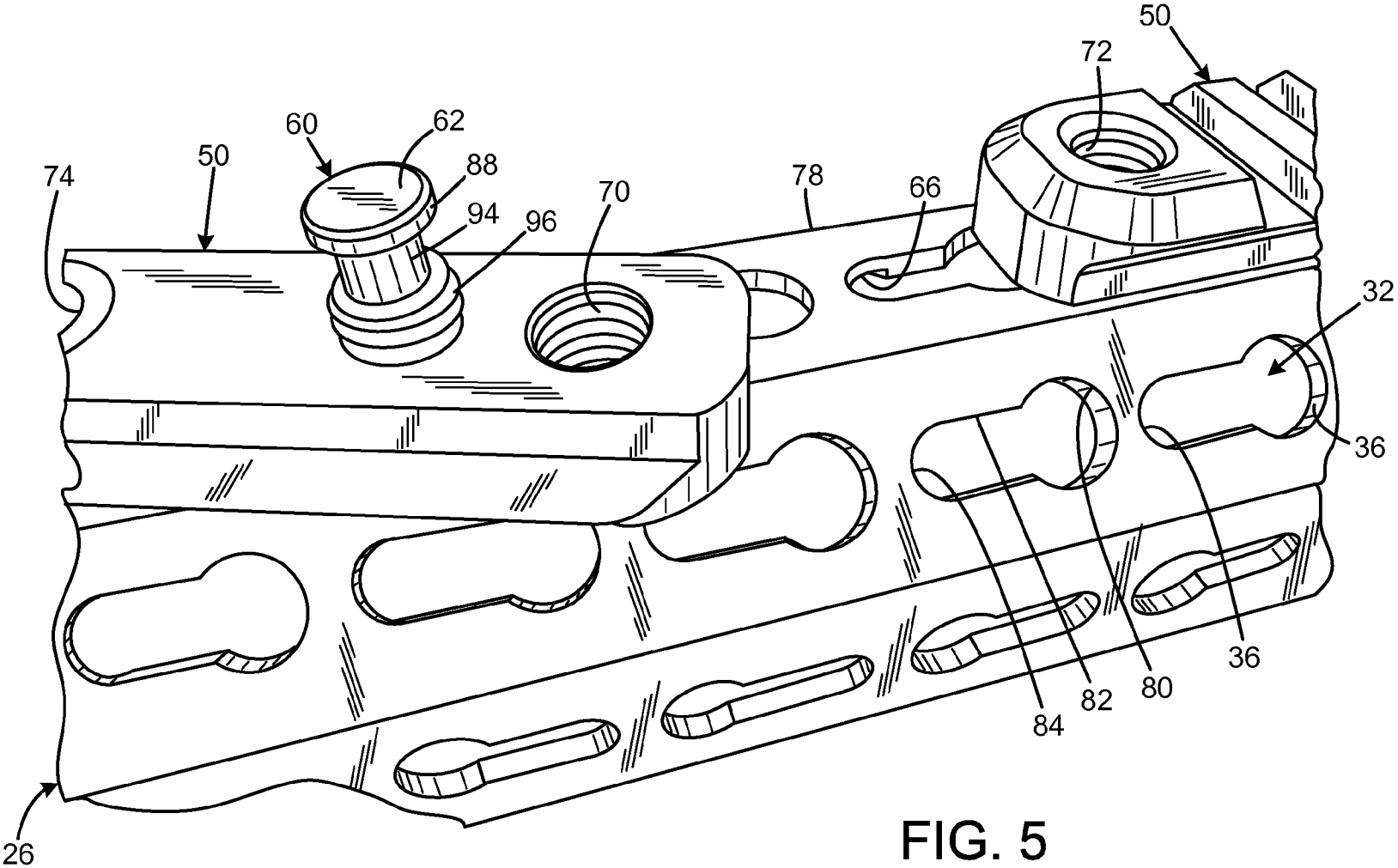
FIG. 5 is a top perspective fragmentary view of the current embodiment of the short rail with flush cup mount, and the forend tube of the present invention.
Figure 6:
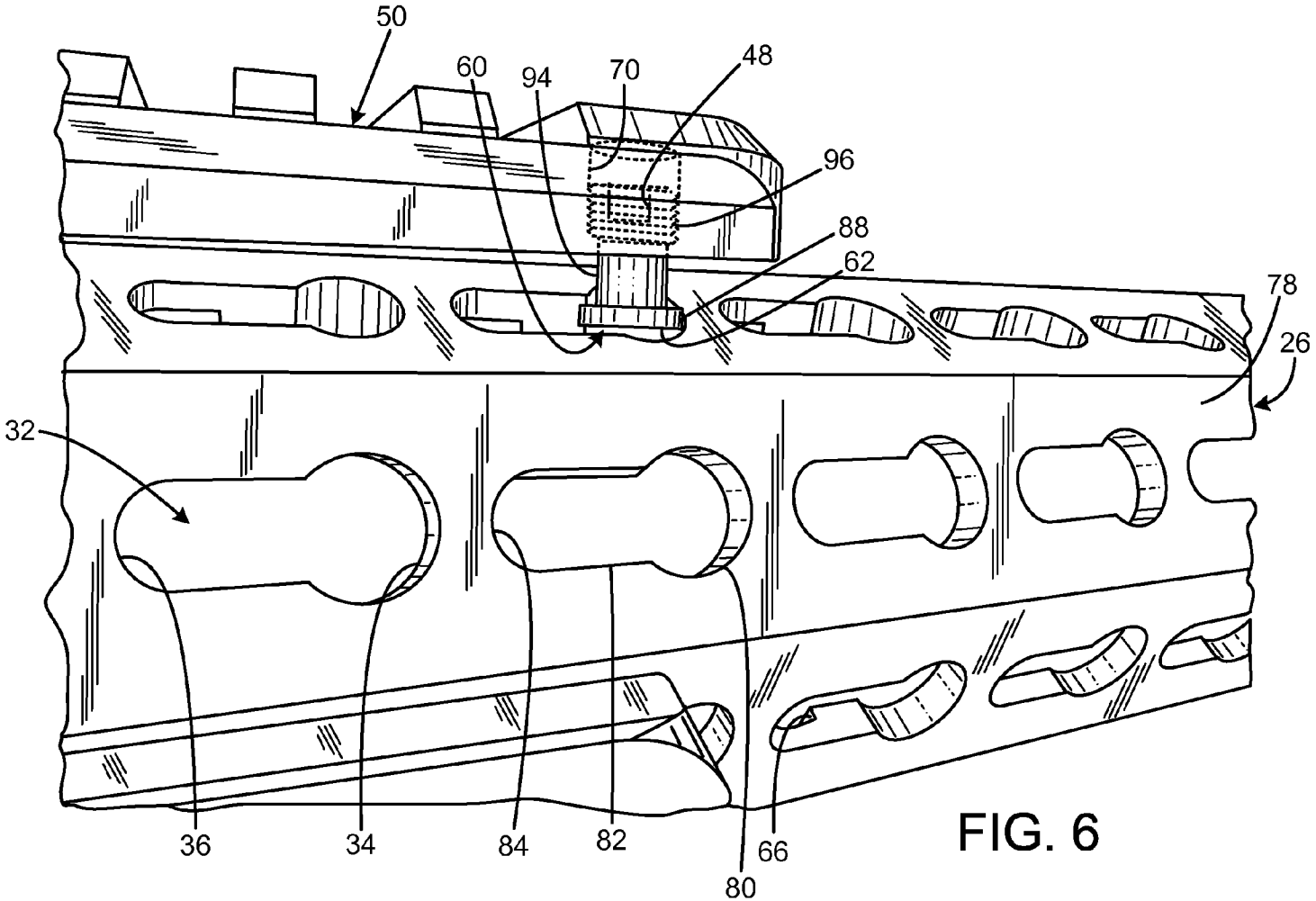
FIG. 6 is a side sectional fragmentary view of the current embodiment of the short rail with flush cup mount and the forend tube of the present invention.

FIGS. 5 & 6 illustrate how the short rail with flush cup mount 50 of the present invention is attached to the exterior surface of the forend tube by T-nuts 60. The T-nuts enable the rail 50 (as well as short rails 46 and 58 and long rail 42) to be removably attached to the exterior surface of the forend tube by first threadedly engaging the threaded portion 96 of a T-nut with the threads in each of the bores in the rail. The T-nuts are positioned within the threaded bores so that the head 62 protrude below the rail by an amount exceeding the thickness of the forend tube. Subsequently, the heads 62 of the T-nuts are axially inserted perpendicularly to an exterior surface of the forend tube into corresponding rear portions of the keyhole slots in the desired locations on the exterior surface. Subsequently, sliding the rail forward parallel to the exterior surface of the forend tube from the rear portion of the keyhole slot into the front portion secures the bottom 76 of the rail to the exterior surface. The socket heads 48 are subsequently tightened by turning the socket heads 48 clockwise to pull the heads of the T-nuts into the recesses 66 in the interior surface of the forend tube to secure the heads within the recesses. Rearward dislocation is prevented by the outer diameter surface 88 of head 62 contacting the interior rear surfaces 86 and 90 of the recess 66. Forward dislocation is prevented by the shaft portion 94 of the T-nut contacting the interior front surface 84 of the keyhole slot 32.

Tightening the socket heads 48 also creates a clamping action between the head 62 and the forend tube to further secure the rail in position.

To remove the rail from the exterior surface, the socket heads are loosened by rotating them counterclockwise so the heads of the T-nuts can be raised above the recesses. Subsequently, the rail is slid backward, parallel to the exterior surface of the forend tube from the front portion of the keyhole slot into the rear portion. The heads of the T-nuts can then be withdrawn from the rear portion of the keyhole slots by axially lifting the rail perpendicularly to the exterior surface.

Figure 7:
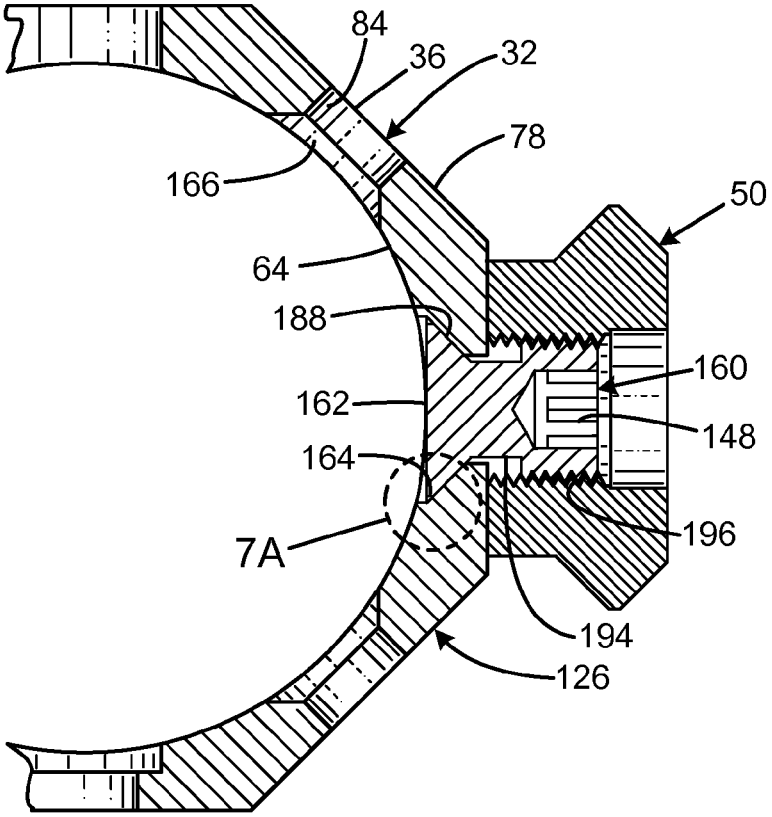
FIG. 7 is an end sectional view of an alternative embodiment of the forend tube of the present invention.
Figure 7A:
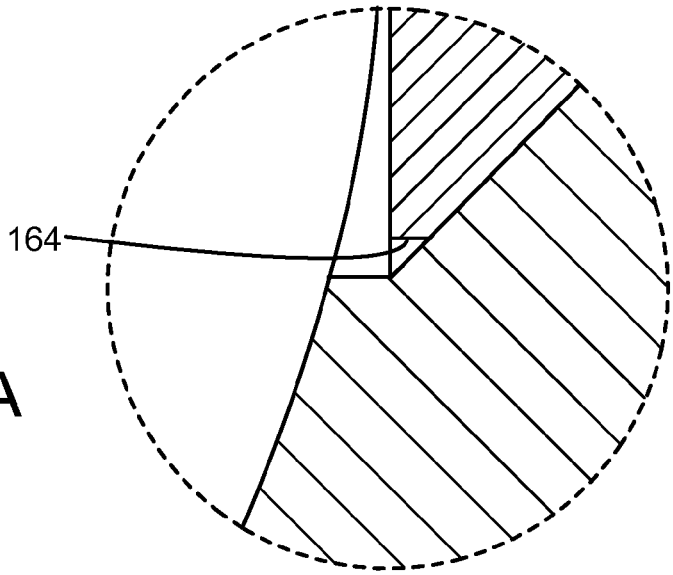
FIG. 7A is an enlarged partial view of the T-nut head received within the chamfered recess of FIG. 7 showing the vertical flat surface of the bottommost portion of the head.

FIGS. 7 and 7A illustrate an alternative embodiment of the forend tube 126 of the present invention with a fastener 160 inserted through the keyhole slot 32 to attach a short rail with flush cup mount 150 to the forend tube. More particularly, the fastener 160 is a T-nut having a shaft portion 194 and a conical tapered head 162 instead of the disc-shaped head 62 found on the fastener 60. The head 162 has an outer diameter surface 188, which is tapered inwardly at an angle ranging from 133.5° to 134.5° with respect to the vertical shaft portion. The head has a maximum diameter of 9.25 mm, which is sized to be received by the chamfered recess 166, and a thickness of 2.3 mm. The bottommost 0.25 mm of the head is a vertical flat surface 164 that is parallel to the shaft portion. The shaft portion has a diameter of 5.0 mm, which is sized to be closely received by the front of the rectangular portion 82, and a length of 2.7 mm. The T-nut is inverted so that the conical tapered head is inserted through the wider rear portion of the keyhole slot and positioned within the forend tube. The head has a maximum diameter that is slightly less than that of the wider rear portion of the keyhole slot, but is greater than the narrower front portion of the keyhole slot. The recess 166 at the front of the keyhole slot is sized to receive the head. The T-nut is flush with the interior of the forend tube when secured and does not project into the interior. Both the outer diameter surface of the head and the interior surfaces of the recess are tapered to provide a centered fit in the manner of a flat head screw without relying on a close dimensional match between recess and head diameter.

In addition to the conical tapered head 162 that engages with the keyhole slot's recess 166, the T-nut includes a threaded portion 196 that terminates in an M8×4 mm threaded hex socket head 148. This features a left-hand thread so the user tightens the socket head in an intuitive clockwise direction although the head 162 is actually drawing out and into the recess 166 in the forend tube. The socket head has a thickness of 4 mm. Each T-nut is fabricated as a single piece.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of the firearm with keyhole-shaped rail mounting points has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm rail mounting facility for connecting an accessory to a forward portion of a firearm, the facility comprising:

a firearm forend barrel shroud element having an exterior surface operable for gripping by a user and an interior surface defining a barrel passage;

the firearm forend barrel shroud element defining a plurality of rail mounting apertures extending from the interior surface to the exterior surface;

each of the apertures having a first portion with a first diameter to closely receive a conical fastener head of a second diameter;

each of the apertures having a second portion with a second width less than the first diameter sized to receive a shank portion of a fastener;

each of the apertures having a chamfered recess on the interior surface sized to receive the conical fastener head, the chamfered recess positioned at the second portion.

2. The mounting facility of claim 1 wherein the plurality of rail mounting apertures are aligned longitudinally parallel to the barrel passage.

3. The mounting facility of claim 1 wherein the plurality of rail mounting apertures are aligned longitudinally parallel to the barrel passage with the second portion in front of the first portion.

4. A firearm with keyhole-shaped rail mounting points, including a barrel having a muzzle, comprising:

a firearm forend barrel shroud tube having a body with an exterior surface;

the exterior surface of the body including a mating feature;

the mating feature having a keyhole-shaped aperture having a wide end and a narrow end; and wherein the forend tube has an interior surface that forms a chamfered recess around the narrow end.

5. The firearm of claim 4, wherein the keyhole-shaped aperture is aligned parallel to the barrel with its narrow end pointing towards the muzzle and its wider end pointing away from the muzzle.

6. The firearm of claim 4, further comprising a plurality of mating features aligned longitudinally parallel to the barrel.

7. The firearm of claim 6, further comprising:

a rail segment removably attached to the body;

the rail segment including a plurality of mating elements received by the mating features; and wherein the rail segment is aligned longitudinally parallel to the barrel.

8. The firearm of claim 7, wherein the rail segment is a rail system for mounting accessories on a firearm.

9. The firearm of claim 7, wherein the mating elements are inverted T-nuts with conical tapered heads.

* * * * *